US005618224A

United States Patent [19]

Dumas

[11] Patent Number: 5,618,224

[45] Date of Patent: Apr. 8, 1997

[54] ROLL CLEANING DEVICE

[75] Inventor: Bernard Dumas, Montbrison, France

[73] Assignee: Clecim, Cergy-Pontoise, France

[21] Appl. No.: 611,521

[22] Filed: Mar. 6, 1996

Related U.S. Application Data

[63] Continuation of Ser. No. 281,212, Jul. 27, 1994, abandoned.

[30] Foreign Application Priority Data

Jul. 28, 1993 [FR] France ..... 93 09306

[51] Int. Cl.[6] ..... B24B 5/00

[52] U.S. Cl. ..... 451/142; 451/49; 451/424; 451/425

[58] Field of Search ..... 451/142, 59, 424, 451/425

[56] References Cited

U.S. PATENT DOCUMENTS

| | | | |
|---|---|---|---|
| 1,429,317 | 9/1922 | Bagi | 451/142 |
| 1,929,639 | 10/1933 | Kettlein | 451/425 |
| 3,481,727 | 12/1969 | Dickinson et al. | 451/424 |
| 4,042,364 | 8/1977 | King et al. | 15/256.52 |
| 4,095,980 | 6/1978 | Satomi | 15/256.52 |
| 4,646,479 | 3/1987 | Walker et al. | 451/59 |
| 4,671,017 | 6/1987 | Ideue et al. | 451/142 |
| 4,677,793 | 7/1987 | Lapsker | 451/424 |
| 4,705,387 | 11/1987 | Lin | 15/256.52 |
| 4,903,084 | 2/1990 | Baltrus et al. | 355/301 |

FOREIGN PATENT DOCUMENTS

| | | |
|---|---|---|
| 1463503 | 1/1966 | France . |
| 1943847 | 3/1970 | Germany . |
| 1959806 | 7/1970 | Germany . |
| 1089711 | 11/1967 | United Kingdom . |

*Primary Examiner*—Bruce M. Kisliuk
*Assistant Examiner*—George Nguyen
*Attorney, Agent, or Firm*—Pollock, Vande Sande & Priddy

[57] ABSTRACT

A device for cleaning or polishing a roll (4), mounted for rotation about an axis and comprising a cleaning roller (41) mounted for rotation on a support device comprising two parallel arms (15, 16) extending, respectively, between an inner end (15*a*, 16*a*) and an outer end (15*b*, 16*b*), and which can be moved between a position in which the roller (41) is applied against the roll (4) and a retracted position, and an arrangement for controlling the rotation of the roller (41) about its axis x'x. The outer ends (15*b*, 16*b*) of the two support arms (15, 16) are articulated about an axis y'y parallel to the axis of the roll (4) respectively on two fixed, aligned bearings (7, 7') which are simultaneously pivotable about the axis y'y in order to apply the roller (41) against the roll (4). The rotation of the roller is controlled from a rotary device (27) centered on the pivoting axis y'y and transmitted to a driven end (19) of the roller (41) by a kinematic chain (26) mounted on the corresponding support arm (15) so as to pivot with it about the axis y'y of the control device (27).

24 Claims, 5 Drawing Sheets

ROLL CLEANING DEVICE

This application is a File Wrapper Continuation Application of U.S. patent application Ser. No. 08/281,212, filed Jul. 27, 1994 now abandoned.

BACKGROUND OF THE INVENTION

1. Field of the Invention

This invention relates to a device for cleaning or polishing a roll, and applies in particular to the cleaning of rolling mill rolls.

2. Technological Background

During the rolling of metal strip, the working surfaces of the rolls in direct or indirect contact with the rolled product have to be cleaned in order to ensure the quality of the surface state. This is particularly true in the case of hot-rolling aluminum.

The cleaning is performed by a tool applied to the working surface of the roll to be cleaned. This tool can advantageously comprise a rotary brush in the form of a brush roller mounted for rotation about an axis parallel to the generating lines of the roll to be cleaned, and an associated driving device which is able to apply rotary torque to at least one end of the brush roller.

A rolling mill generally comprises two working rolls placed on either side of the feed path of the product to be rolled, and at least two back-up rolls which the sides of the working rolls opposite to the feed path bear against, a clamping force being applied between the pressure rolls. The diameter of the working rolls is relatively small, and thus the cleaning device must be passed into a fairly restricted space delimited by the columns of the stand, the product being rolled and the pressure roll(s). The cleaning device is therefore normally mounted on a support that can move inside this space between a position in which the brush roller is applied against the roll to be cleaned and a retracted position used, for example, when starting up the mill or carrying out maintenance operations.

Many cleaning devices have been suggested for this purpose.

The brush roller is often mounted in rotary fashion on a support device comprising two parallel arms, the free ends of which are fitted with centering brush roller centering bearings. The arms are mounted on a chassis which can slide in a plane parallel to the axis of the brush roller between a brush roller application position and a retracted position. Moreover, to provide better access to the roll, the device supporting the brush roller can advantageously be made to pivot about a fixed axis in order to move it to a rest position away from the rolling mill rolls (DE-A-1.959.806).

According to another known arrangement, the brush roller support device is mounted on a set of articulated arms forming a deformable parallelogram (DE-A-1.943.847).

The means that drive the brush roller in rotation must be able to follow the movements of the support device. The brush roller can, for example, be associated with at least one driving wheel wedged on one of its ends, and connected by a chain to a rotation control wheel mounted on the support and which moves with the support (DE-A-1.959,806). In this case, the motor torque must be transmitted, for example, via an elongation piece fitted with a universal joint so that the movements of the support can be followed (DE-A-1.959, 806). The rotation control device may also be fixed, but this requires the use of a Galle chain and means for maintaining its tension, since the length of the kinematic chain that connects the rotation control device to the shaft of the brush roller will vary according to its position (DE-A-1.943.847).

Moreover, to ensure proper cleaning and avoid scratches forming on the roll, the brush roller must also be subject to a "to-and-fro" type axial movement parallel to the axis of the roll in order to correctly distribute the brushing effect over the whole surface of the roll (FR-4-1.463.503).

In view of all the problems to be overcome, devices of the prior art are fairly complex and bulky.

The brush roller or roll often needs to be removed, and, given the mechanical complexity of the cleaning assemblies, this implies numerous relatively long and costly dismantling operations.

Moreover, development in rolling techniques is leading to a whole array of auxiliary devices being associated with the rolling mill, designed for example to compensate for deformation and adjust the distribution of stresses applied to the product, and all of these reduce the space in which the cleaning device can be placed.

SUMMARY OF THE INVENTION

The invention presents an optimal solution to all these problems, thanks to a cleaning device that is more effective, simpler and less bulky than devices of the prior art.

The invention relates to a device for cleaning or polishing a roll, and which is mounted so as to rotate about an axis, the device comprising:

a support device articulated about a fixed axis y'y located away from the roll to be cleaned and parallel to the axis of the roll, the support device comprising two parallel arms extending, respectively, between an inner end directed towards the roll and an outer end directed towards the exterior;

a cleaning tool in the form of a cylindrical roller mounted in rotary fashion at its ends on two bearing carried respectively by the inner ends of the support arms, the rotational axis of the brush roller defined by said bearings being substantially parallel to the axis of the cylinder;

means for controlling the displacement of the support device between a position in which the brush roller is applied against the roll and a retracted position;

means for controlling the rotation of the brush roller about its axis x'x, comprising a rotary control device to which a motor torque is applied and means for transmitting the torque forming a kinematic chain between the rotary control device and at least one driving device wedged onto at least one driven end of the brush roller.

According to the invention, the outer ends of the two support arms are articulated, about a fixed axis y'y parallel to the axis of the roll, respectively, on two aligned bearings each carried by a fixed support, and are associated with means for controlling simultaneous pivoting of the support arms in order to apply the cleaning brush roller against the roll. The rotation control device on the driven end of the brush roller is carried by the bearing of the support arm of the driven end, and is centered on the pivoting axis y'y, the entire kinematic chain assembly that transmits the motor torque being mounted on the support arm in such a way as to pivot with it about the axis of the rotation control device.

It may be seen that the brush roller support merely comprises two arms of the same length rotating about two fixed bearings mounted away defining a fixed pivoting axis on which is centered the rotation control device.

Moreover, since the entire kinematic chain is carried by one of the two arms and pivots with it in order to apply the brush roller to the roll, the two arms can be independent of each other and assume slightly different orientations, the brush roller therefore remaining applied against the roll and following any possible misalignment of the roll.

To transmit the rotary torque to the brush roller, it is therefore no longer necessary to use, as in known arrangements, complicated systems such as cardan extension pieces in order to follow the movements of the brush roller between its retracted position and application position against the roll.

The driving device and rotation control device preferably comprise, respectively, two toothed wheels that are kinematically connected and mounted in rotary fashion, respectively, about the rotational axis of the brush roller and the pivoting axis of the support arms.

According to a first embodiment, the kinematic chain comprises at least one idle pinion mounted in the central part of the support arm and simultaneously engaging on both sides with the brush roller rotation control toothed wheel and driving toothed wheel.

However, the respective diameters of the brush roller rotation control toothed wheel and driving toothed wheel can be determined according to the distance between the pivoting axis of the support arms and the rotational axis of the brush roller in such a way that said wheels directly mesh with each other.

The free intermediary pinion can also be replaced by a Galle type transmission chain which engages on the two toothed wheels.

According to a further advantageous embodiment of the invention, the rotation control device is linked to the corresponding end of the brush roller via an axially sliding link which can transmit the rotary torque to the brush roller with the possibility of axially displacing the latter.

This sliding link preferably comprises a shaft centered on the axis of the brush roller and linked in rotation with one end of the brush roller via an articulated meshing means such as a toothed swivel joint. The shaft has teeth around its periphery which mesh with the corresponding slots on the internal face of a sleeve, the periphery of which has a toothed part that forms the rotation control device.

To provide a swiveling link with the corresponding end of the brush roller, the sliding shaft has a spherical part housed in a hollow spherical socket made in a step bearing fixed on to the end of the brush roller. This spherical part has claws which engage in the corresponding grooves of the step bearing so as to rigidly lock the two parts together in rotation with a possibility of universal articulation to allow for any misalignment of the rotational axes of the control device and brush roller.

In a similar way, the end opposite the driven end of the brush roller is carried, with the possibility of articulation, by a rod mounted so as to slide axially and without the possibility of rotation, on the end of the second support arm, the end of said rod facing the brush roller being fitted with a swiveling bearing having an inner case fixed on to the rod and an outer case fixed on to the corresponding end of the brush roller.

The brush roller is also associated with means for effecting a "to-and-fro" axial movement, these means preferably bearing directly on one end of the brush roller in the axis of the brush roller and determining an alternating displacement parallel to its axis.

In an advantageous way, the end of the sliding rod facing away from the brush roller forms a piston mounted so as to slide axially in a bush forming the body of a jack fixed on to the sleeve and fed with oil to control the axial displacement of the brush roller by acting on the piston.

Due to these arrangements, the invention makes it possible to considerably reduce the overall dimensions of the cleaning device and its rotary driving means and also to simplify dismantling of the brush roller by providing direct access to the roll without having to dismantle the driving devices.

Moreover, in the case where the brush roller is used to clean one of the mill working rolls, it is particularly advantageous to mount the pivoting bearing blocks of the brush roller support arms directly on the chocks of the roll.

The arrangements according to the invention considerably simplify maintenance and repair operations.

The cleaning device of the invention also better resists deformation forces due to misalignments of the brush roller and makes it possible to reduce bearing block wear while allowing fine adjustment of the "to-and-fro" axial movement.

Moreover, the cleaning device can also be associated with means for adjusting the pressure exerted by the brush roller on the roll. These means comprise, at each end of the brush roller, a cam mounted on the corresponding end of the support arm and which rotates about the axis of, respectively, the shaft or rod, and whose shape is eccentric with respect to this axis. The cam bears on a fixed stop which, in the case of a rolling mill, can be mounted on a corresponding part of a chock of the roll.

According to a preferred embodiment of the invention, the arm supporting the driven end of the brush roller is in the form of a hollow case in which the driving device, rotation control device and kinematic chain are placed.

Moreover, the swiveling link between the rotation control shaft and the corresponding end of the brush roller can advantageously include a spherical part provided at the end of the shaft and housed in a hollow spherical socket made in a step bearing fixed on to the end of the brush roller. The spherical part has claws which engage in the corresponding grooves of the step bearing so as to rigidly interlock the two parts in rotation with the possibility of articulation.

The invention also covers a rolling mill comprising a frame in which at least two mill rolls are housed, at least one of these rolls having a cleaning device comprising the preceding embodiments.

BRIEF DESCRIPTION OF THE DRAWINGS

The invention will be better understood and other advantages and characteristics revealed from the following description of a number of exemplary embodiments of the invention. These should be read in conjunction with the accompanying drawings, in which.

DESCRIPTION OF THE PREFERRED EMBODIMENTS

Figure 1:
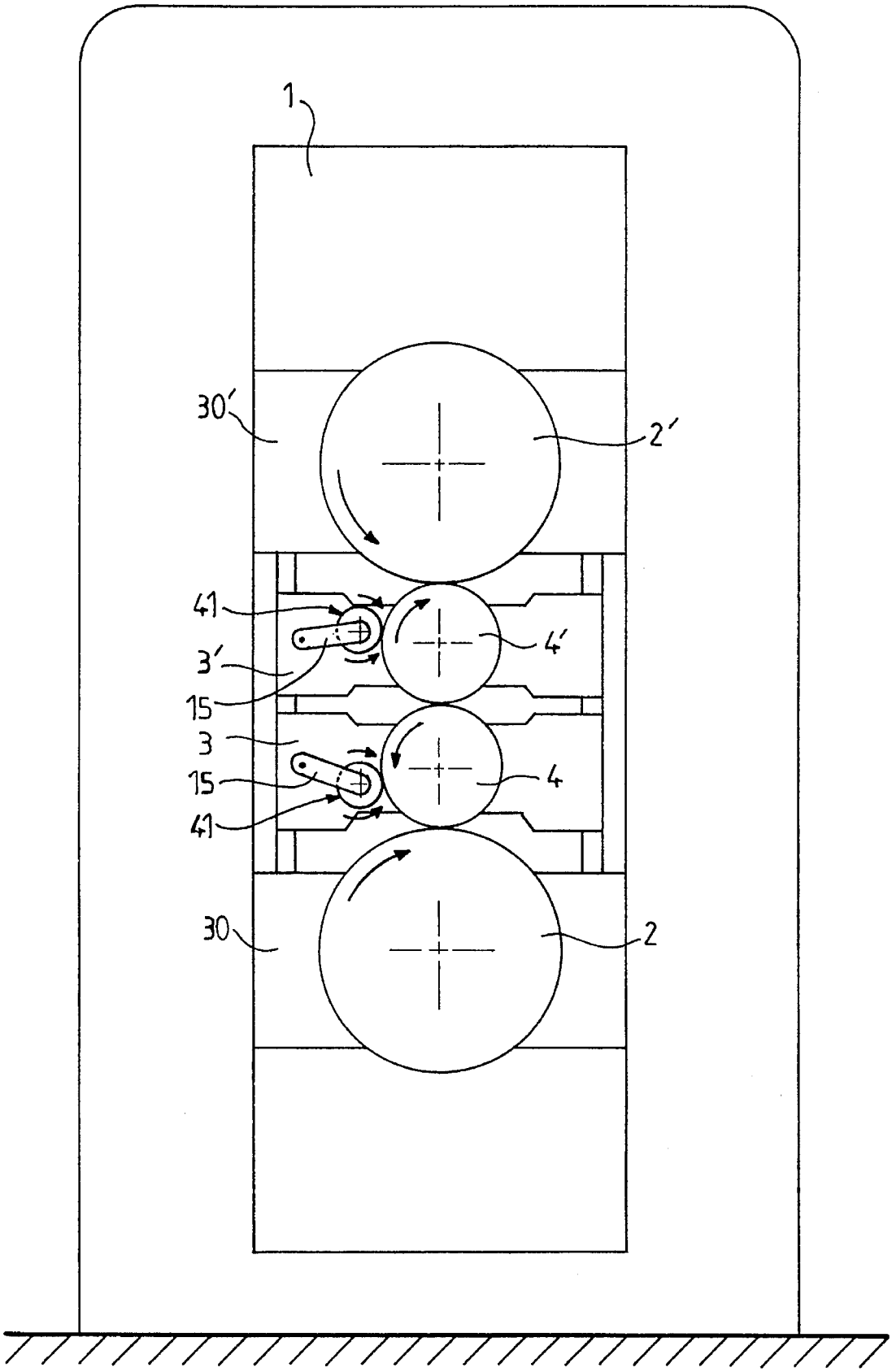
FIG. 1 is a cross-sectional view of a Quarto rolling mill, shown in the vertical plane passing through the axes of the rolls.

The vertical cross-section in FIG. 1 is a schematic drawing of a rolling mill assembly fitted with cleaning devices, particularly for the working rolls.

For the purposes of an example, this rolling mill is a Quarto rolling mill, and therefore includes, between the two uprights of a stand 1, two pressure rolls 2, 2' and two working rolls 4,4', carried at their ends by two chocks, respectively 30, 30', which are mounted for vertical sliding movement along the guide parts provided on the uprights of stand 1.

In the example shown, each working cylinder 4, 4' is associated with a cleaning device made up of a brush 41 in the form of a cylindrical roller which is driven in rotation about its axis and applied against the corresponding cylinder. However, as shown in FIG. 3, two cleaning rollers could advantageously be used, placed symmetrically on either side of the clamping plane of the rolls.

Figure 2:
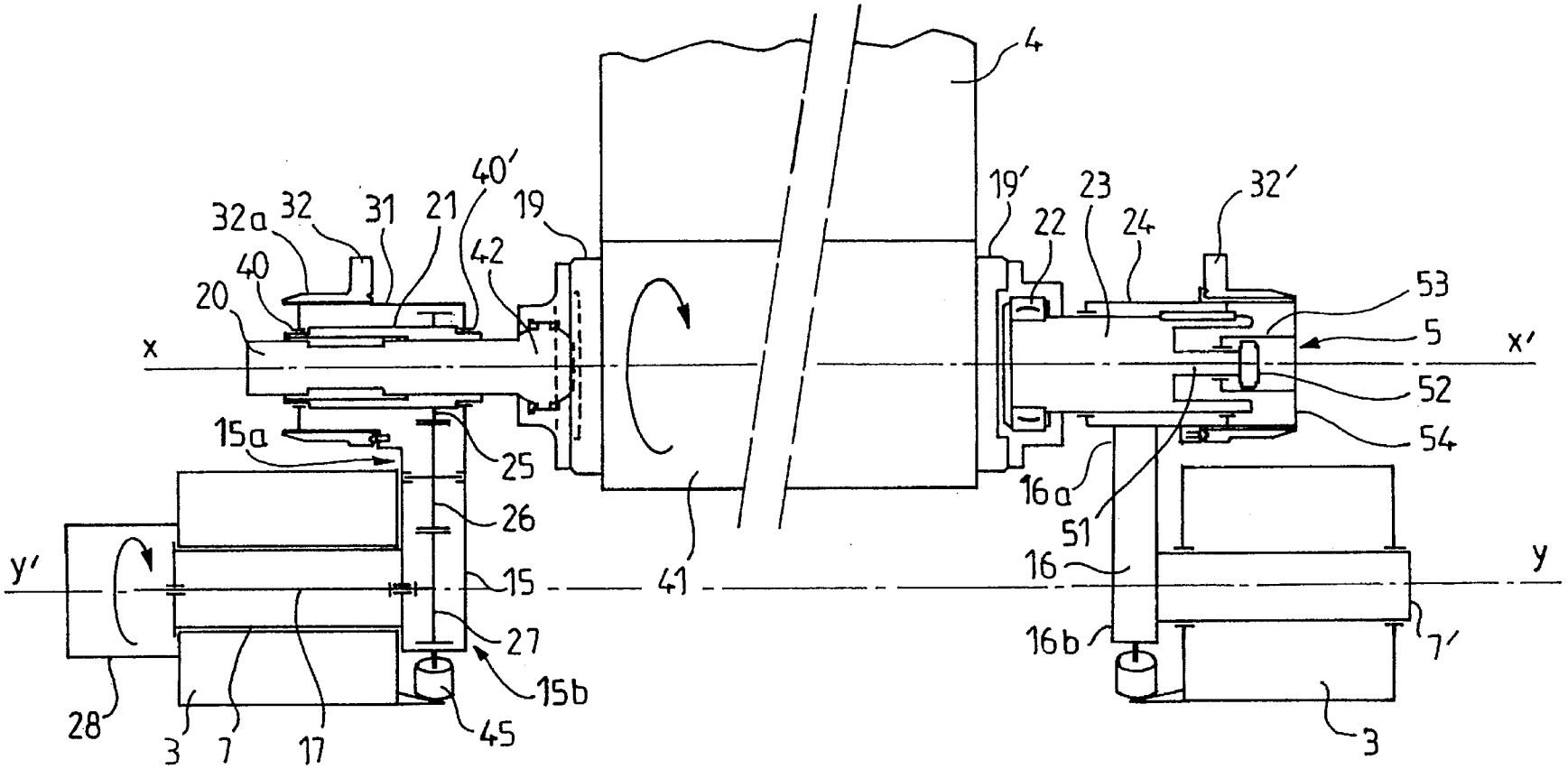
FIG. 2 is a cross-sectional view along line II—II of FIG. 3 and shows the main elements of a brushing device according to the invention.
Figure 3:
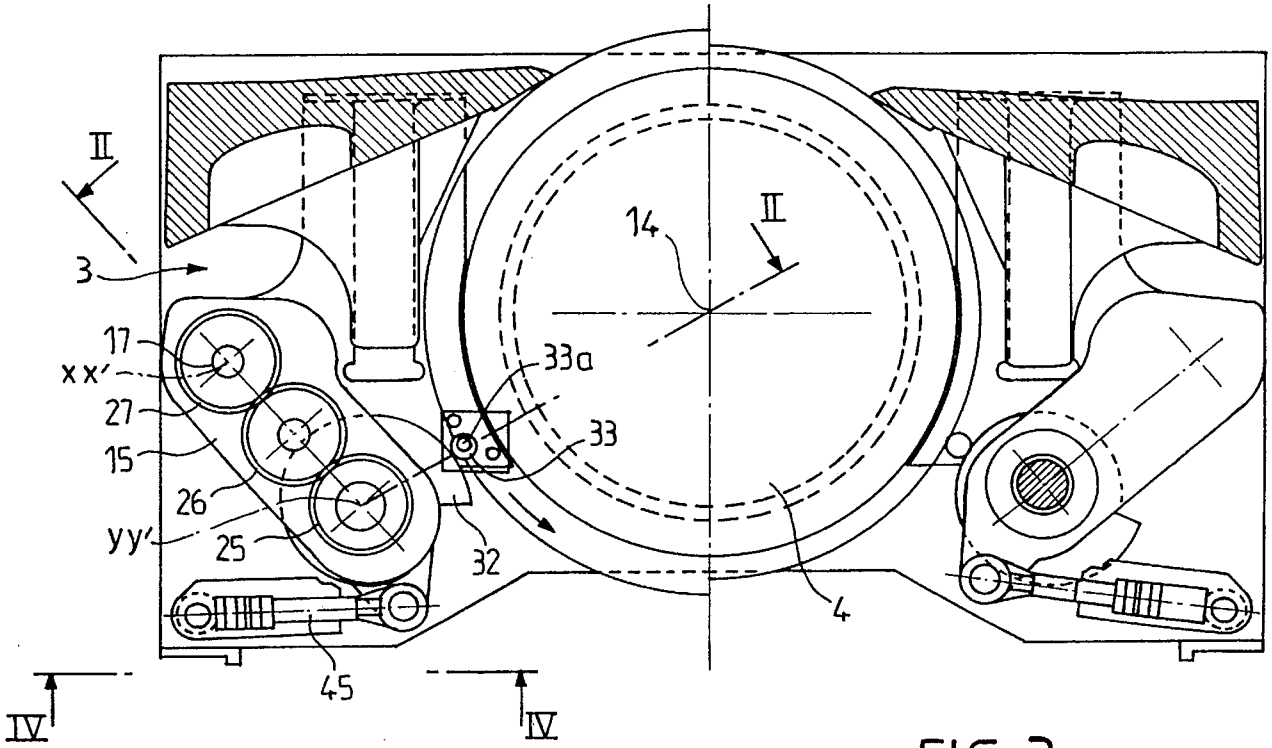
FIG. 3 is a side view of a chock carrying the brushing device of the invention.

Since these devices are all identical, the following description makes reference to the lower working roll shown in FIGS. 2 and 3.

Likewise, for reasons of clarity, conventional parts and elements needed for correct operation of a rolling mill will not be described.

According to an essential feature of the invention, each cleaning roller 41 is articulated on the ends of two support arms, the other ends of which are pivotably mounted on fixed bearings which, in the case of a rolling mill, are advantageously carried by the chocks of the roll to be cleaned.

FIG. 2 shows schematically a cleaning device in the form of a longitudinal cross section along a plane passing through axis x'x of the brush and pivoting axis y'y of the support arms.

Rotary brush 41 is shown in its position of application against roll 4 to be cleaned and turns about an axis 13 which is substantially parallel to the rotational axis of roll 4.

The device supporting brush 41 only comprises two substantially parallel arms 15, 16, each extending between an inner end 15*a*, 16*a* facing roll 4, and an outer end 15*b*, 16*b* facing the exterior.

Rotary brush 41 is carried at its ends by two shafts 20, 23, which turn in bearings 40, 41' housed in the inner ends 15*a*, 16*a*, of the two support arms 15 and 16. The support arms are pivotably mounted on two bearings 7, 7' which define a single pivoting axis y'y, the bearings 7, 7' being carried by fixed supports which, in the case of a rolling mill, are, respectively, the two chocks 3, 3' of roll 4.

It can therefore be seen that with the exception of the brush roller 41 which extends between the inner ends of the two arms 15, 16, arms 15, 16 are completely independent of each other.

In the schematic view shown in FIG. 2, only the corresponding parts of chocks 3, 3' are shown.

In the example shown, brush 41 is driven in rotation at one of its ends 19 by a rotary driving device 25 which is centered on corresponding shaft 20 and rigidly locked to it in rotation.

The rotary torque is applied to a rotary control device 27 centered on pivoting axis y'y of the corresponding support arm 15 and is transmitted to driving device 25 by a kinematic chain mounted on arm 15 so as to turn with this arm.

Figure 5:
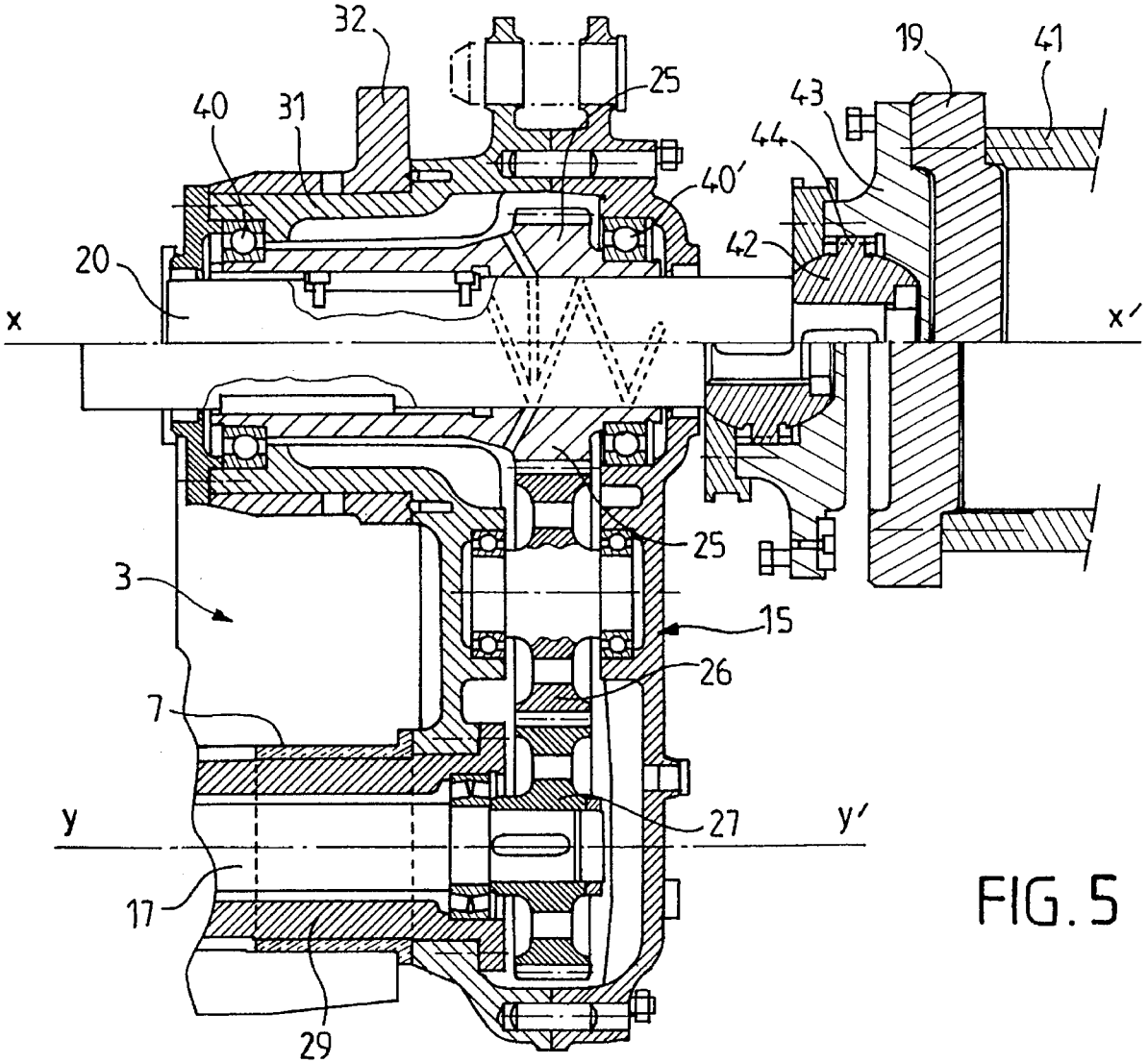
FIG. 5 is a detail view of the rotation control kinematic chain.

As shown in detail in FIG. 5, support arm 15 advantageously comprises a hollow case mounted in such way that it can be made to pivot about axis y,y', on chock 3, by hollow shaft 29 in which control shaft 17 passes and on which the motor torque is applied.

The kinematic chain mounted inside the case that forms arm 15 comprises two toothed wheels, these being, respectively, control device 27 centered on pivoting axis y'y and driving device 25 centered on shaft 20 of brush roller 41. These two toothed wheels 27, 25 mesh with an intermediate idle pinion 26 mounted on case 15 between toothed wheels 27, 25.

In a particularly advantageous way, the command torque is applied directly on control shaft 17 by a motor 28 fixed on to support 3.

It can therefore be seen that all the means for controlling the rotation of brush roller 41 turn with arm 15 about axis y'y whenever brush roller 41 moves from the retracted position to the application position on roll 4.

The rotation of the two arms 15, 16 can advantageously be controlled by two jacks 45 bearing on supports 3,3', and being fixed in synchronism.

It should be noted that individual control of the rotation of the two arms 15, 16 allows any misalignment between the axis of roll 4 and the axis of brush roller 41 to be absorbed. For this reason, the two shafts 20, 23 of the brush roller are connected, respectively, to the two ends of the roller via devices 19, 19' which allow a small amount of misalignment, as will be described later in this description.

Moreover, as mentioned above, it is useful to be able to make the brush roller effect a "to-and-fro" axial movement parallel to its axis, the two shafts 20, 23 therefore being able to move axially with respect to support arms 15, 16.

On the driven end 19 side of roller 41, i.e. on the left of FIG. 2, drive shaft 20 is provided with splines which engage in corresponding grooves provided on the inside face of a sleeve 21, which has a toothed part which forms driving wheel 25. Shaft 20 can thus be driven in rotation in sliding axial fashion.

Sleeve 21 is rotatably mounted in a tubular piece 31 by two spaced roller bearings 40, 40', the tubular piece being fixed on to the inner end of arm 15. An embodiment is shown in detail in FIG. 5.

In a comparable way, the opposite end 19' of brush roller 41 is mounted in rotary fashion on the end of a shaft 23 which is axially slidable on the inner end of second support arm 16.

Since shaft 23 does not control the rotation of brush roller 41, it can be made up of a simple rod that is fixed in rotation and connected to end 19' of brush roller 41 by a swiveling roller bearing 22. Rod 23 is grooved and slides axially in an internally grooved sleeve 24 fixed on to the inner end 16*a* of arm 16.

Due to the inner grooving of sleeves 21 and 24, shaft 20 and rod 23 are able to slide axially with brush roller 41, drive shaft 20 remaining rigidly locked in rotation with command device 27.

To allow possible misalignment between brush roller axis x'x and the axis of drive shaft 20, the end of drive shaft 20 facing the brush roller is fitted with a head 42 in the form of a hemispherical swivel joint housed in a piece forming bearing 43 which can be movably fixed on end 19 of brush roller 41.

Swivel joint 42 is fitted with claws 44 that engage in the corresponding grooves of step bearing 43 so as to allow the rotary torque to be transmitted without interfering with the articulation.

In the service position, step bearing 43 is fixed on to end 19 of brush roller 41, with shaft 20 being able to slide freely in sleeve 21 and follow the "to-and-fro" axial movement applied to brush roller 41 and to drive the brush roller at the same time.

As mentioned above, rod 23, which is connected to brush roller 41 by a swiveling roller bearing 22, is able to slide, without turning, parallel to a fixed direction in sleeve 24 fixed on to arm 16 integral with chock 3'. The "to-and-fro" axial movement device 5 associated with brush roller 41 can also be considerably simplified, as shown in FIG. 2 and, in greater detail, in FIG. 6.

The end of rod 23 facing brush roller 41 has a central rod 51 carrying a piston 52 which is slidable inside a bush 53 fixed on to the end of sleeve 24 by a base 54. The assembly thus constitutes a double-action jack supplied by pipes 55 drilled inside sleeve 24.

Due to these arrangements, which make it possible to integrally house the control devices for rotational and "to-and-fro" axial movement in, respectively, the two support arms 15 and 16, dismantling of the assembly is considerably simplified.

Step bearing 43 as well as the external case of swiveling roller 22 are simply secured by bolts to the corresponding ends 19, 19' of roller brush 41.

Figure 6:
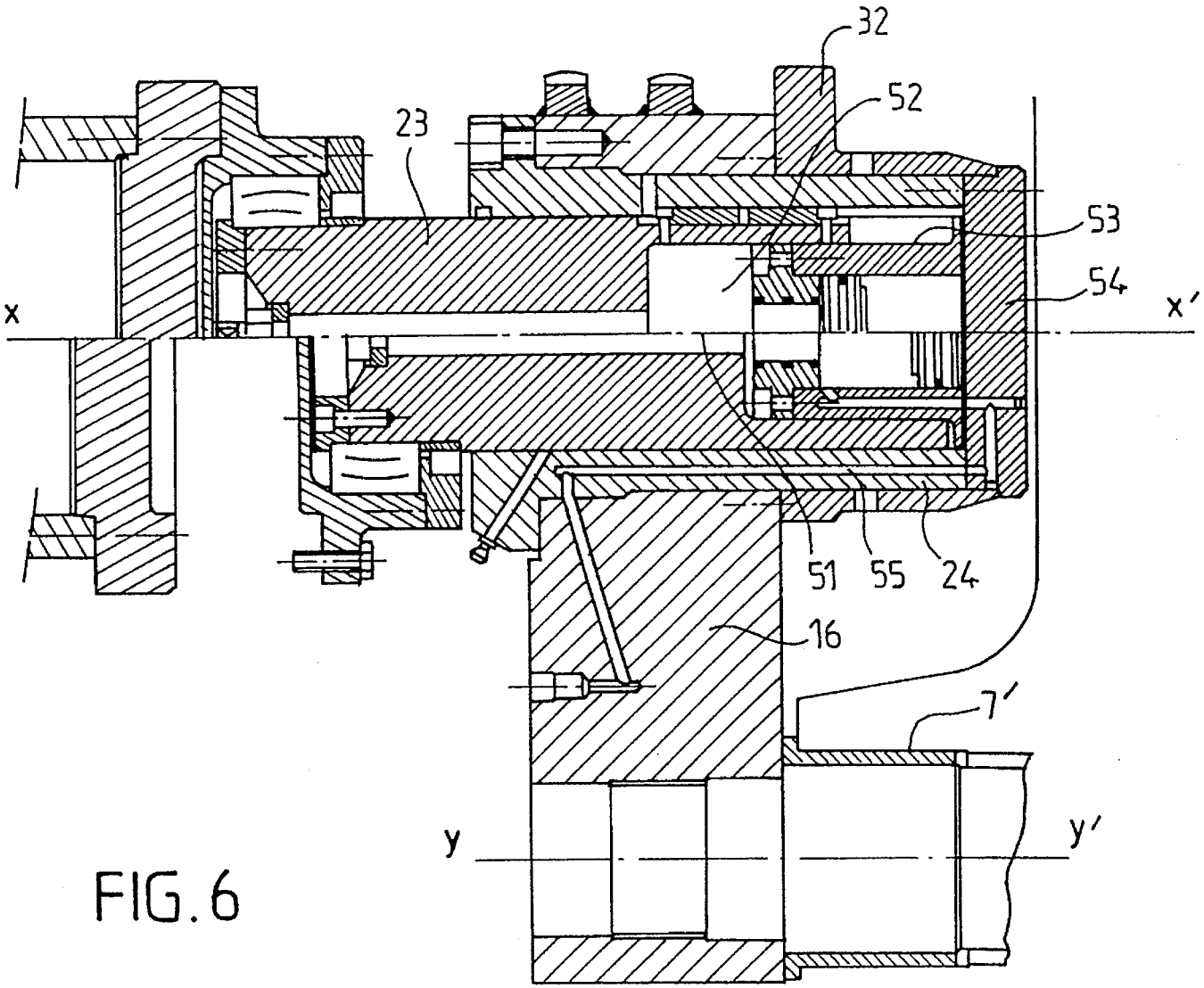
FIG. 6 is a detail view of the "to-and-fro" movement device.

As shown in the partial cross-section in FIGS. 5 and 6, it is only necessary to slacken the fixing screws and to slide shafts 20, 23 in their sleeves 21, 24 in order to disengage step bearing 43 and roller bearing 22 and free brush roller 41. The driving and "to-and-fro" movement devices fixed to the ends of arms 15 and 16 therefore remain integral with, respectively, chocks 3, 3' and can be dismantled normally.

The motor torque can be applied to shaft 17 quite satisfactorily. However, in the case of a rolling mill, it is particularly advantageous to employ a separate motor 28 for brushing device 11. This separate motor can be mounted on chock 3 of the roll or directly on arm 15.

Other means could also be employed to control the driving of the brushes, for example, a device common to all the brush devices installed on the rolling mill.

According to another embodiment of the invention, shaft 17 can be wedged on a pinion connected to roll 4 by a kinematic chain such as a gear or belt.

The rotation control device is intended to drive the brush in either direction according to rolling constraints.

As shown in FIG. 3, each working roll 4, 4' can be associated with two rotary brushes 41, 41' placed on either side of the clamping plane, the rotary brushes being applied against roll 4 by jacks 45 which are articulated on chock 3 and bear on the free end of support arm 15.

Moreover, according to another advantageous embodiment of the invention, each rotary brush 41 can be associated with a pressure device which makes it possible to maintain the position of the brush roller relative to roll 4 and also to adjust the pressure exerted.

Figure 4:
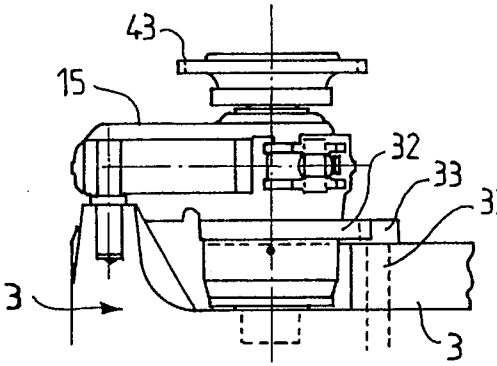
FIG. 4 is a partial view along line IV—IV of FIG. 3.

Such a device is shown in FIGS. 3 and 4 and comprises a cam 32, 32' located at each end of brush roller 41 and bearing against an end stop 33.

As shown in FIG. 2, cam 32 is fixed on to a bush **32*a* that turns on end 31 of arm 15. It has a rounded shape and is eccentric relative to axis 20*a* of rotation control shaft 20. Cam 32' has the same eccentric shape and turns about axis 23*a* of the "to-and-fro" axial movement control rod 23**.

When brush roller 41 is applied against roll 4 by jacks 45, the two cams 32, 32' mounted at the ends of arms 15, 16 bear upon two end stops 33 fixed, respectively, to the corresponding lateral faces of chock 3. Brush roller 41 is thus held in a fixed position with respect to roll 4, the distance between their axes being constant. Cams 32, 32' provide a means of adjusting the parallelism of the axes and the pressure exerted by the brush roller.

Moreover, each end stop 33 is advantageously made up of a bush turning about an axis **33*a* which passes through the lateral face of the chock and whose profile is eccentric with respect to its rotational axis. The opposite end of the bush can be fitted with an indexing device (not shown) that allows end stop 33** to be turned, and which may include an appropriately graduated scale.

Cams 32, 32' form a rough means of adjustment and are set in the workshop to adjust the mean deviation between the brush roller axis and the axis of the roll at each end, and as a result the penetration of the brush.

This angular positions of the two cams 32, 32' can then be varied as and when required in order, for example, to adjust the parallelism of the brush roller with roll 4.

The eccentric end stops 33 on which cams 32, 32' bear therefore form a fine means of adjustment which can be used during rolling, in particular to adjust the rubbing effect of the brush according to the surface state of roll 4.

Since the two end stops 33, 33' are independent, the adjustment value set on the motor side and on the "to-and-fro" axial movement side can be different.

It can be seen that due to the arrangements described above, the two support arms 15 and 16 can take up slightly different orientations in order to correctly apply brush roller 41 against roll 4, the brush roller 4 being able to slide axially without interfering with the rotation control means, the motor torque being transmitted to the brush roller via pivoting axis 10 of the arms. This therefore completely obviates the use of telescopic cardan extension pieces and enables simpler dismantling.

If the distance between pivoting axis 10 of arms 15 and 16 and the rotational axis of the tool is relatively small, idle pinion 26 can be omitted and the diameters of gears 25 and 27 determined such that the two gears mesh directly with each other.

Idle pinion 26 could also be replaced by a Galle transmission chain that meshes with gears 25 and 27.

Moreover, as already mentioned, it is advantageous to place the rotation control means on one of the chocks 3, and the "to-and-fro" axial movement control means on the other chock 3'.

However, according to one variant, it would also be possible to group all the control means on the same chock, the "to-and-fro" axial movement piston being mounted on tubular piece 31 on the side facing brush roller 41 and bearing on shaft 20 via a turning end stop.

While we have described a cleaning device applied to a working roll, it is clear that similar devices could be associated with the back-up rolls.

What is claimed:

1. Device for cleaning or polishing a roll, and which is mounted so as to rotate about an axis, said device comprising:

(a) a support device articulated about a fixed axis y'y away from the roll to be cleaned and parallel to the axis of the roll, said support device comprising two parallel support arms extending, respectively, between an inner end directed towards the roll and an outer end directed towards the exterior;

(b) a cleaning tool in the form of a brush roller mounted in rotary fashion at its ends on two bearings carried respectively by the inner ends of said support arms, the rotational axis of the brush roller defined by said bearings being substantially parallel to the axis of said roll;

(c) means for controlling the displacement of the support device between a position in which the brush roller is applied against the roll and a retracted position;

(d) means for controlling the rotation of the brush roller about its axis x'x comprising at least one rotary control device to which a torque is applied by a motor supported coaxially with said fixed axis y'y and means for transmitting said torque forming a transmission assembly between said at least one rotation control device and at least one driving device fixed on rotation onto at least one driven end of the brush roller;

wherein:

(e) the outer ends of the two support arms are articulated about an axis y'y parallel to the axis of the roll to be cleaned, respectively, on two aligned bearings each carried by a fixed support, and are associated with means for controlling simultaneous pivoting of said arms in order to apply the brush roller against the roll;

(f) the rotation control device on the driven end of the brush roller is carried by the bearing of the support arm of said driven end and is centered on said pivoting axis y'y;

and (g) the transmission assembly that transmits the motor torque is mounted on said support arm in such a way as to pivot with it about axis y'y of the rotation control device.

2. The device of claim 1, wherein the rotary driving device and rotation control device comprise, respectively, two toothed wheels that are kinematically connected and mounted in rotary fashion, respectively, about rotational axis x'x of the brush roller and pivoting axis y'y of the support arm.

3. The device of claim 2, wherein the respective diameters of the two toothed wheels, respectively, the control wheel and driving wheel, are determined according to the distance between the pivoting axis y'y of the arms and the rotational axis x'x of the brush roller, in such a way that the said toothed wheels directly mesh with each other.

4. The device of claim 2, wherein the rotary driving toothed wheel on the brush roller is connected to the control toothed wheel on which the motor torque is applied by a transmission chain.

5. The device of claim 2, wherein at least one pinion is mounted in free fashion on the arm between the driving toothed wheel and control toothed wheel so as to simultaneously mesh with said toothed wheels.

6. The device of claim 1, wherein the support arm of the driven end of the brush roller is in the shape of a hollow case inside which the control device, driving device and transmission means are placed.

7. The device of claim 1, wherein the rotary driving device is fixed onto the driven end of the brush roller by means of an axially sliding link which is able to transmit the rotational torque to said brush roller by means of a sliding transmission permitting relative axial displacement of said brush roller with respect to the support arm carrying the driving device.

8. The device of claim 7, wherein the sliding link comprises a shaft centered on the axis of the brush roller and linked in rotation with said brush roller, one end of said shaft having teeth around its periphery which engage with corresponding grooves provided on the inner face of a tubular sleeve, said tubular sleeve having a toothed part on its periphery forming the rotary driving device.

9. The device of claim 1, wherein the rotary driving device is linked to the corresponding end of the brush roller by a swiveling link which is able to transmit the rotary torque to the brush roller for possible misalignment of the rotational axes of the driving device and brush roller.

10. The device of claim 8, wherein the shaft is connected to the corresponding end of the brush roller by an articulated gear means comprising a spherical part provided on the end of said shaft and which is housed in a hollow spherical socket made in a step bearing fixed on to the end of the brush roller, said spherical part having claws which engage in the corresponding grooves of the bearing in order to rigidly lock the two parts together in rotation for possible articulation.

11. The device of claim 1, wherein the end opposite the driven end of the brush roller is carried, with the possibility of articulation, by a rod mounted for axial sliding movement on the end of the second support arm.

12. The device of claim 11, wherein the rod is slidably non-rotatably mounted inside a sleeve fixed on to the free end of the second support arm, and is fitted, at its end facing the brush roller, with a swiveling roller having an inner case mounted on the rod and an outer case fixed on to the corresponding end of the brush roller.

13. The device of claim 10, wherein the step bearing forming the outer part of the swiveling link is removably fixed on the corresponding end of the brush roller so as to be able to be released and moved away towards the exterior by sliding the shaft to allow the brush roller to be dismantled.

14. The device of claim 12, wherein the external case of the swiveling bearing is removably fixed on to the corresponding end of the roller in such a way that it can be released and moved away towards the exterior by sliding the rod to allow the brush roller to be dismantled.

15. The device of claim 1, wherein the brush roller is associated with means for effecting a "to-and-fro" axial movement that bear directly upon one end of the brush roller, in the axis of said roller, in order to determine an alternating displacement of the brush roller parallel to its axis.

16. The device of claim 11 or 12, wherein the end of the rod facing away from the brush roller forms a piston axially slidably mounted in a bush forming the body of a jack fixed on to the sleeve and fed with oil to control the axial displacement of the brush roller by acting on the piston.

17. The device of claim 1, including means for adjusting the distance between the axis x'x of the brush roller and the axis of the roll in the brush roller application position.

18. The device of claim 16, wherein the means for adjusting the position of application of the brush roller comprise, at each end of the brush roller, a cam mounted on the corresponding end of the corresponding support arm, said cam being rotatable about the axis, respectively, of the shaft or rod, and having a shape eccentric with respect to said axis, said cam bearing on an end stop mounted on a corresponding part of the corresponding chock.

19. The device of claim 18, wherein the end stop is mounted for rotation about an axis and has an eccentric shape with respect to said axis so as to allow fine adjustment by rotation about said axis.

20. The device of claim 1, wherein a motor couple is applied by a motor device specific to the control device and carried by the fixed support device of the bearing block or the corresponding arm.

21. Rolling mill comprising a frame in the form of a stand having two uprights, at least two rolling rolls being housed between said uprights, at least one of said rolling rolls being fitted with a cleaning device of claim 1.

22. The rolling mill of claim 21, wherein each rolling roll is carried, at its ends, by a pair of chocks slidably mounted respectively, in two uprights of the stand, the pivoting bearing blocks of the two supporting arms of the brush roller associated with a roll being fixed, respectively, on the two chocks of said rolling roll.

23. The rolling mill of claim 21 or claim 22, wherein the motor torque controlling the rotation of each cleaning roller is applied from each roll to be cleaned, said roll being linked kinematically to the rotation control device of said brush roller.

24. Device for cleaning or polishing a roll which is mounted so as to rotate about an axis, said device comprising:

(a) a cylindrical cleaning roller having two ends;

(b) two parallel support arms extending respectively between an inner end directed towards the roll and carrying said cleaning roller, and an outer end directed towards the exterior;

(c) said outer ends of the two support arms each being articulated about a same pivoting axis (y'y) parallel to the axis of the roll to be cleaned, respectively, on two aligned bearings each carried by a fixed support;

(d) said support arms being associated with means for controlling simultaneous pivoting of said arms between a first retracted position of the cleaning roller and a second application position in which the said cleaning roller is applied against said roll to be cleaned;

(e) the two ends of said cleaning roller being rotatably mounted respectively on two bearings which are carried respectively by said inner ends of said two arms, said bearings defining a rotational axis (x'x) of said cleaning roller which is substantially parallel to the axis of the roll to be cleaned;

(f) driving means for controlling the rotation of the cleaning roller about its axis (x'x), said driving means being mounted on at least a first support arm and comprising:

(g) a rotation control device to which a rotational motor torque is applied and which is centered on said pivoting axis (y'y) of said first arm;

(h) a rotary driving device for applying said rotational motor torque to a driven end of said cleaning roller corresponding to said first arm;

(i) a kinematic transmission assembly for transmitting said rotational motor torque between said rotation control device and said driving device, said transmission assembly being mounted on said first support arm in such a way as to pivot with it said pivoting axis (y'y);

(j) said rotary driving device being fixed on to the said driven end of the cleaning roller by means of an axially sliding link which is able to transmit the rotational torque to said cleaning roller by means of a sliding transmission permitting a relative axial displacement of said cleaning roller with respect to said first support arm carrying the rotary driving device.

* * * * *